US006401308B1

(12) United States Patent
Kawahara

(10) Patent No.: US 6,401,308 B1
(45) Date of Patent: Jun. 11, 2002

(54) TAPE-MOUNTED SNAP FASTENER HAVING ENGAGEMENT AND DISENGAGEMENT DIRECTIONALITY

(75) Inventor: Masahiko Kawahara, Minou (JP)

(73) Assignee: Morito Co., Ltd., Osaka (JP)

( * ) Notice: Subject to any disclaimer, the term of this patent is extended or adjusted under 35 U.S.C. 154(b) by 0 days.

(21) Appl. No.: 09/624,742

(22) Filed: Jul. 25, 2000

(30) Foreign Application Priority Data

Sep. 16, 1999 (JP) ..... 11-261365

(51) Int. Cl.[7] ..... A44B 17/00
(52) U.S. Cl. ..... 24/114.4; 24/901; 24/584.1
(58) Field of Search ..... 24/114.4, 92, 96, 24/104, 114.05, 114.8, 584.1, 581.1, 629, 662, 681, 682, 693, 697.1, 403, 697.2, 584.11, 586.1, 586.11, 588.1, 588.12, 585.11

(56) References Cited

U.S. PATENT DOCUMENTS

| | | | | | |
|---|---|---|---|---|---|
| 569,213 | A | * | 10/1896 | Lehnig | 24/588.12 |
| 573,829 | A | * | 12/1896 | Mixer et al. | 24/662 |
| 1,337,118 | A | * | 4/1920 | Carr | 24/662 X |
| 1,593,452 | A | * | 7/1926 | Hertzman | 24/697.2 X |
| 1,678,166 | A | * | 7/1928 | Repay | 24/581.1 |
| 2,379,896 | A | * | 7/1945 | Fitzgerald, Jr. | 24/662 |
| 3,350,752 | A | * | 11/1967 | Plummer | 24/584.1 |
| 3,545,048 | A | * | 12/1970 | Daddona, Jr. et al. | 24/586.11 |
| 3,751,770 | A | * | 8/1973 | Italiano | 24/697.1 |
| 4,665,588 | A | * | 5/1987 | Nakano | 24/16 PB |
| 4,819,309 | A | * | 4/1989 | Behymer | 24/586.11 |

FOREIGN PATENT DOCUMENTS

| | | |
|---|---|---|
| DE | 871 732 | 7/1949 |
| DE | 33 11 680 A1 | 10/1983 |
| JP | A-10-33210 | 2/1998 |
| JP | 10033210 | 2/1998 |
| WO | WO 83/01182 | 4/1983 |
| WO | WO 00/69300 | 11/2000 |

* cited by examiner

*Primary Examiner*—Anthony Knight
*Assistant Examiner*—Ruth C. Rodriguez
(74) *Attorney, Agent, or Firm*—Merchant & Gould P.C.

(57) ABSTRACT

From the "face" side of the base (12) of the male part (4), an engagement protrusion (18) extends directly upwards in the direction of the engagement socket (18). On the surface of the engagement socket (14) side of the base (12), a slanting surface (12*a*) parallel with the protrusion-forming slanting surface (18*b*) is formed. From the "face" side of the base (20) of the male part (8), an engagement protrusion (23) extends diagonally downwards in the direction of the engagement socket (21). On both sides of the step (23*c*), a wall (23*e*) is provided. On the "face" side of the engagement socket (21) of the base (20), a slanting surface (20*a*) parallel with the protrusion-forming slanting surface (23*b*) is formed. The snap fastener has directionality in respect not only of disengagement but also of engagement.

6 Claims, 4 Drawing Sheets

(a)

(b)

TAPE-MOUNTED SNAP FASTENER HAVING ENGAGEMENT AND DISENGAGEMENT DIRECTIONALITY

FIELD OF THE INVENTION

The present invention relates to a tape-mounted snap fastener having engagement and disengagement directionality. When male and female parts of this type of fastener are provided on two separate fabrics, the fabrics can be disengaged only from a certain direction and not from other directions. This kind of snap fastener having such a directionality can be used in a variety of applications including clothing, bags and shoes.

BACKGROUND OF THE INVENTION

The present applicant has developed and made patent applications for snap fasteners of this kind having disengagement directionality.

For example, the invention disclosed in JP-A-10-33210 (1998) is a tape-mounted snap fastener with tapes comprising a male-side tape consisting of resin male snap parts mould-fastened on a cloth tape at free intervals and a female-side tape consisting of resin female snap parts mould-fastened on a cloth tape at free intervals, using a resin-molding means. The male snap part has an attachment protrusion sticking out from the center of a male base part, said attachment protrusion comprising a neck part and an attachment head, wherein said neck part is concentric with the male base part while said attachment head is eccentric from the axial center of the neck part to form an engagement edge. The female snap part has a female base part having a head-inserting guide hole for inserting the attachment protrusion, an attachment hole through which the attachment head passes as it elastically changes its form, and a head chamber hole encasing the attachment head, wherein said head-inserting guide hole is concentric with the attachment hole while said head chamber hole is eccentric from the insertion center so as to correspond to the eccentricity of the attachment head of the male snap part, and a stopper step is formed at least on the eccentric side of the periphery of the head chamber hole. The attachment strength of this snap fastener differs depending on the direction in which it is pulled apart.

In the invention of the above application, directionality appears when the male snap part and the female snap part are disengaged, but there is no directionality when they are engaged. There is an advantage to this arrangement in that the male and female parts can be engaged to each other without any sense of obstruction, but it also makes the user apt to forget the directionality in which the snap fastener can be pulled apart. If the user attempts to pull apart the male and female sides in directions in which they are difficult to separate, the fabrics on which the snap parts are attached can be damaged.

SUMMARY OF THE INVENTION

The object of the present invention is to provide a snap fastener that has directionality not only for disengagement but also for engagement.

The tape-mounted snap fastener having an engagement and disengagement directionality according to the present invention comprises a male tape and a female tape in which the male tape consists of a cloth tape on which several synthetic resin male parts are molded and fastened at certain intervals and the female tape consists of a cloth tape on which several synthetic resin female parts are molded and fastened at certain intervals, characterized in that from the "face" side of the base of the male part the engagement protrusion extends diagonally upwards in the direction of the engagement socket, while a slanting surface parallel with the protrusion-forming slanting surface is formed within the engagement socket, on the "face" side of the base, and from the "face" side of the base of the female part the engagement protrusion extends diagonally downwards in the direction of the engagement socket, while a slanting surface parallel with the protrusion-forming slanting surface is formed within the engagement socket, on the "face" side of the base, forming the space for housing the male part engagement protrusion when the male and female parts are engaged.

Preferably, the protrusion-forming slanting surface on the engagement socket side of the male part is provided with a small protrusion, and the protrusion-forming slanting surface on the engagement socket side of the female part is provided with a step. In this way, the small protrusion of the male part engages with the step of the female part when the male and female parts are completely engaged.

The slant angle of the protrusion-forming slanting surfaces of the male and female parts is from 30 to 60 degrees, and preferably 45 degrees.

The heads of the engagement protrusions of the male and female parts are preferably arranged parallel with their respective cloth tapes in order to make the snap as thin as possible.

At least one of the male and female parts is preferably provided with a mark that indicates the directionality of the engagement.

According to the present invention, the male part and the female part engage or disengage in such a way that they slide on their respective protrusion-forming slanting surfaces. Therefore, the snap fastener of the present invention has directionality not only for disengaging the male and female parts but also for engaging them. Moreover, when they are completely engaged, the small protrusion of the male part sits on the step of the female part to stabilize the engagement.

DESCRIPTION OF THE DRAWINGS

An example of the present invention will now be described with reference to the accompanying drawings, in which.

DESCRIPTION OF A PREFERRED EMBODIMENT

Figure 1A:
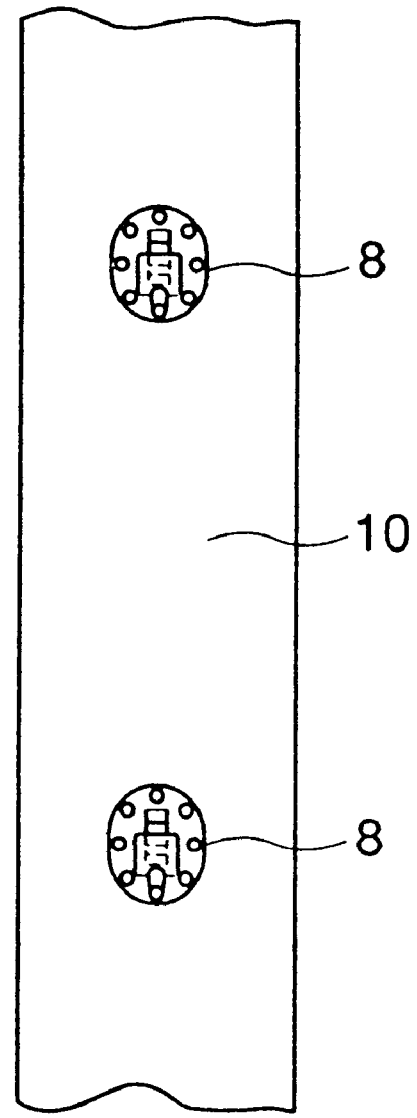
FIG. 1 is a plan view of the tape-mounted fastener 2 according to the embodiment of the present invention.
Figure 1B:
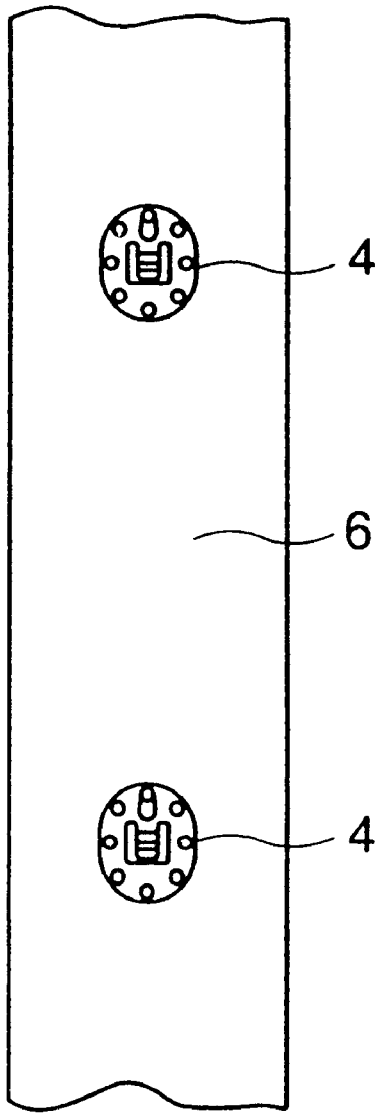
Figure 1B:
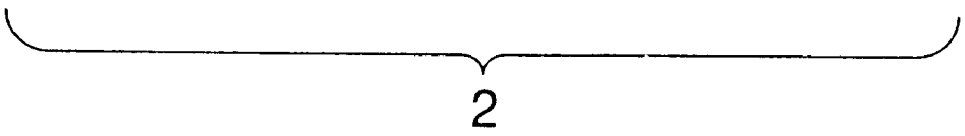

FIG. 1 is a top view of a tape-mounted fastener 2 of one example of the present invention. It consists of a tape 6 (FIG. 1(*b*)) on which synthetic resin male parts 4 are attached and a tape 10 (FIG. 1(*a*)) on which synthetic resin female parts 8 are attached. FIG. 1(*a*) is drawn with the engagement surface up. This side is called the "face" side, and the surface opposite the "face" side is called the "back" side. FIG. 1*b* is drawn with the side opposite the engagement surface up. This side is called the "back" side, and the engagement surface side is called the "face" side.

Figure 2:
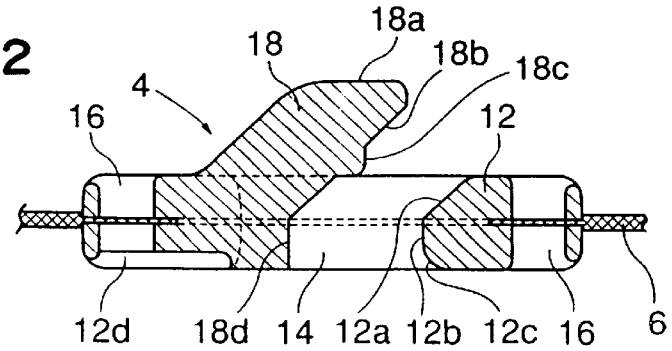
FIG. 2 is a cross sectional view of a male part 4.
Figure 3:
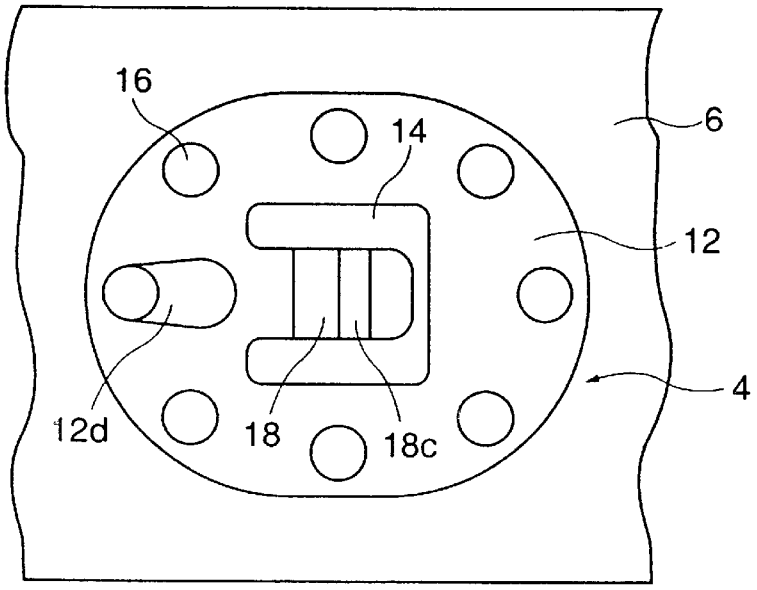
FIG. 3 is a back view of a male part 4.
Figure 4:
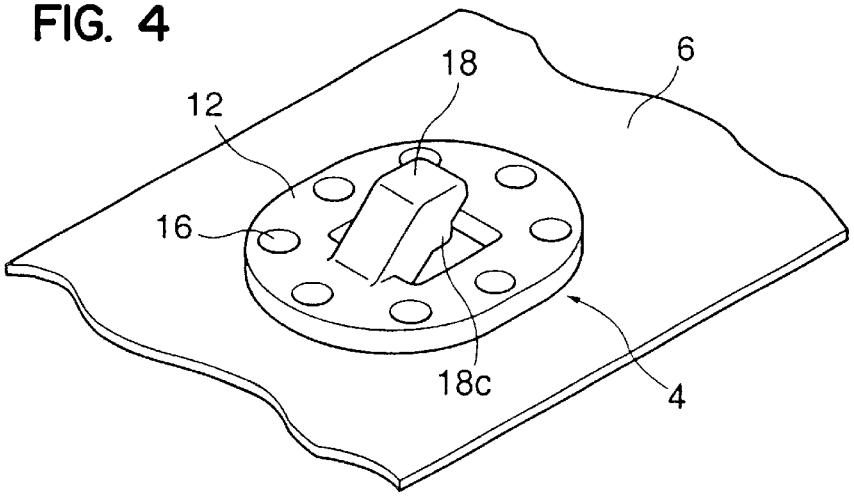
FIG. 4 is a perspective view of a male part 4.

FIGS. 2–4 show the male part 4. FIG. 2 is a cross sectional view, FIG. 3 is a back view and FIG. 4 is a perspective view. The base 12 of the male part 4 is generally elliptical, and is firmly adhered to the cloth tape 6 provided with engagement sockets 14 by injection molding. So that the tape 6 does not become twisted by the injection pressure during the injection molding process, the upper and lower dies for molding the peripheral part of the base 12 are provided with several pins (not shown) that press the tape 6. Because of this process, there are holes 16 on the base 12 that have a shape complementing the pin shape.

From the "face" side of the base 12, the engagement protrusion 18 extends diagonally upwards in the direction of the engagement hole 14. The head 18*a* of this protrusion is parallel with the cloth tape 6, and on the protrusion-forming slanting surface 18*b* a small protrusion 18*c* having a triangular cross section is formed on the engagement hole side. The slant angle of the protrusion-forming slanting surface 18*b* is from 30 to 60 degrees, and preferably 45 degrees. There is no protrusion-forming slanting surface on the "back" side of the base 12, but there is a perpendicular surface 18*d*.

On the other hand, on the "face" side of the engagement socket 14 of the base 12, a slanting surface 12*a* that is parallel with the protrusion-forming slanting surface 18*b* is formed. On the "back" side of the engagement socket 14 of the base 12, a perpendicular surface 12*b* and a curved surface 12*c* that spreads out from the perpendicular surface 12*b* are formed. Numeral 12*d* is an indentation that serves as a mark indicating the engagement direction. This indentation 12*d* is not an essential part of the present invention.

Figure 5:
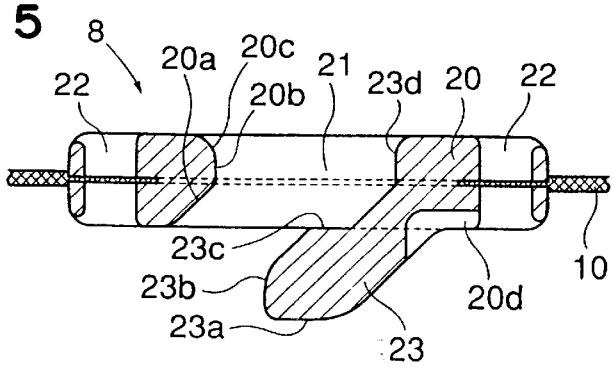
FIG. 5 is a cross sectional view of a female part 8.
Figure 6:
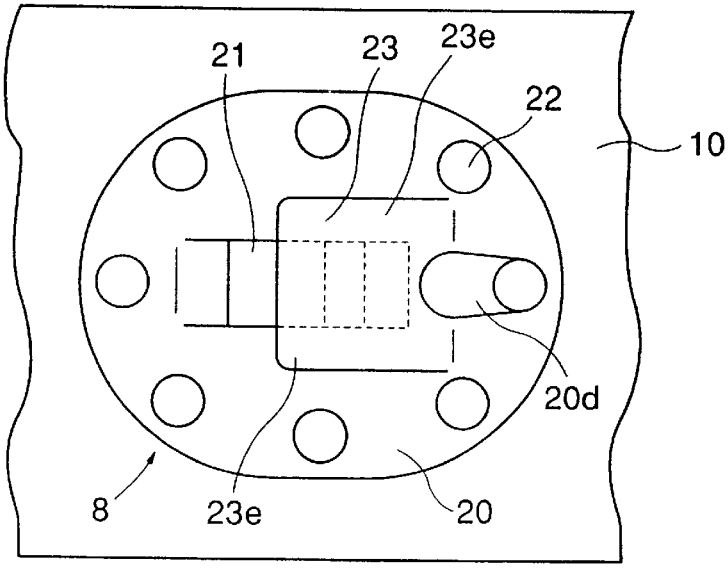
FIG. 6 is a plan view of a female part 8.
Figure 7:
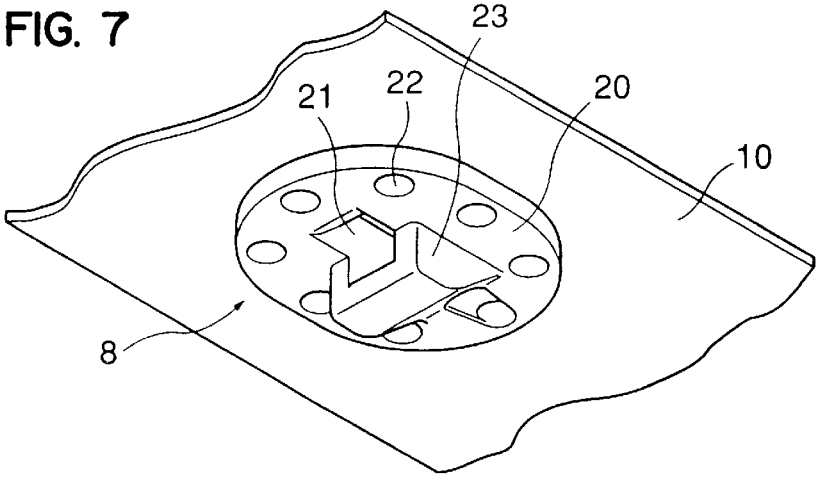
FIG. 7 is a perspective view of a female part 8.

FIGS. 5–7 show the female part. FIG. 5 is a cross sectional view, FIG. 6 is a plan view and FIG. 7 is a perspective view. The base 20 of the female part 8 is also generally elliptical, and is firmly adhered to the cloth tape 10 provided with engagement sockets 21 by injection molding. So that the tape 10 does not become twisted by the injection pressure during the injection molding process, the upper and lower dies for molding the peripheral part of the base 20 are provided with several pins (not shown) that press the tape 10. Because of this process, there are holes 22 on the base 20 that have a shape complementing the pin shape.

From the "face" side of the base 20, the engagement protrusion 23 extends diagonally upwards in the direction of the engagement hole 21. The head 23*a* of this protrusion is parallel with the cloth tape 10, and on the protrusion forming slanting surface 23*b* a step 23*c* is formed on the engagement hole side. The slant angle of the protrusion-forming slanting surface 23*b* is from 30 to 60 degrees, and preferably 45 degrees. There is no protrusion-forming slanting surface on the "back" side of the base 20, but there is a perpendicular surface 23*d*.

As shown in FIG. 7, the engagement protrusion 23 of the female part 8 is different from the engagement protrusion 18 of the male part 4 in that it has a wall 23*e* on both of its sides, forming the engagement socket 21 as well as the space for housing the male part engagement protrusion when the male and female parts are engaged.

On the other hand, on the "face" side of the engagement socket 21 of the base 20, a slanting surface 20*a* that is parallel with the protrusion-forming slanting surface 23*b* is formed. On the "back" side of the engagement socket 21 of the base 20, a perpendicular surface 20*b* and a curved surface 20*c* that spreads out from the perpendicular surface 20*b* are formed. Numeral 20*d* is an indentation that serves as a mark indicating the engagement direction. This indentation 20*d* is not an essential part of the present invention.

Figure 8:
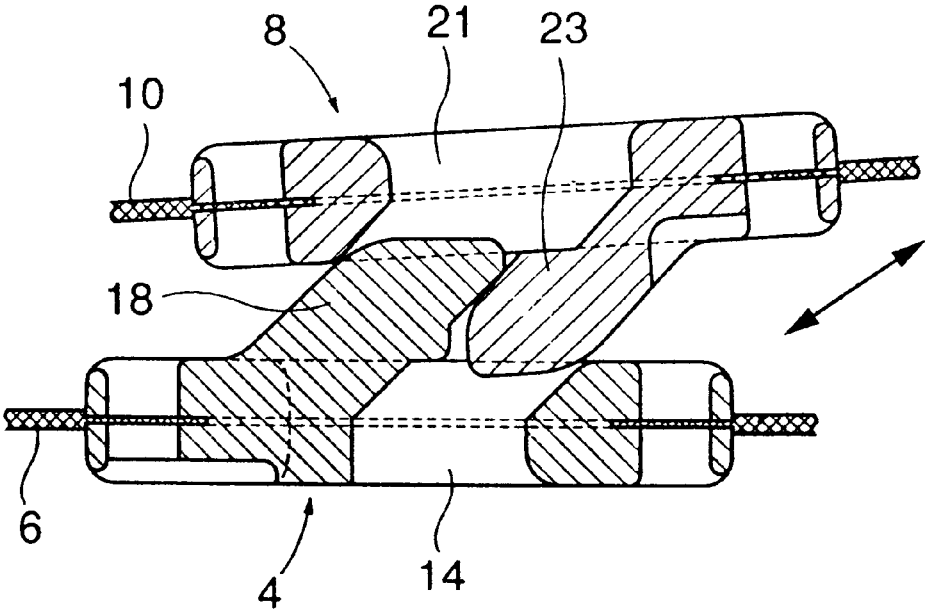
FIG. 8 is a cross sectional view showing a process in which the male part 4 and the female 8 are being engaged or disengaged.
Figure 9:
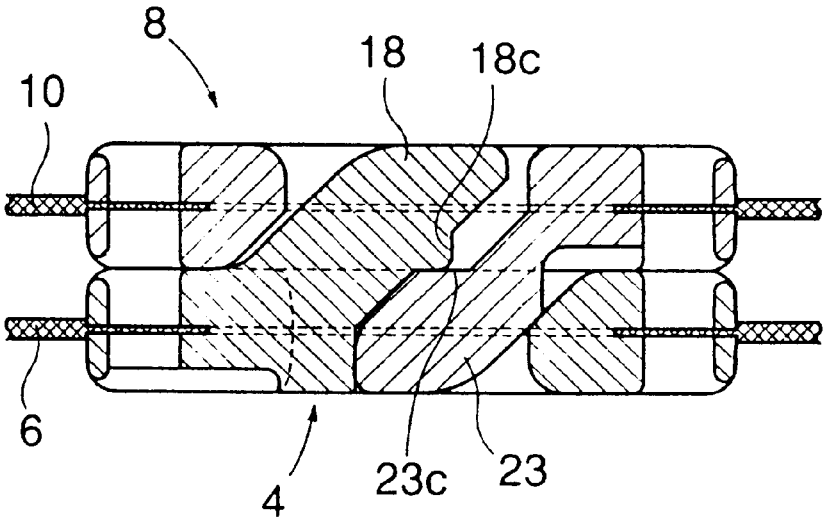
FIG. 9 is a cross sectional view showing a male part 4 and a female part 8 as they are engaged.

FIG. 8 is a cross sectional view showing a process in which the male part 4 and the female part 8 are being engaged or disengaged. FIG. 9 is a cross sectional view of the male and female parts engaged. As is evident from FIG. 8, the male part 4 and the female part 8 engage or disengage in such a way that they slide on their respective protrusion-forming slanting surfaces. Therefore, the snap fastener of the present invention has directionality not only for disengaging the male and female parts but also for engaging them. Moreover, when they are completely engaged, the small protrusion 18*c* of the male part 4 sits on the step 23*c* of the female part 8 to stabilize the engagement.

In the drawings and specification, there has been set forth a preferred embodiment of the invention, and although specific terms are employed, they are used in a generic and descriptive sense only and not for purpose of limitation, the scope of the invention being set forth in the following claims.

What is claimed is:

1. A tape-mounted snap fastener having engagement and disengagement directionality comprising:

a male tape made of a cloth tape on which a plurality of synthetic resin male parts are molded and fastened at certain intervals, said male part comprising a base having a face side and a back side, an engagement socket in the base, an engagement protrusion having a first slanting surface and a second slanting surface and extending diagonally upwards at a slant angle in the direction of the engagement socket from the face side of the base, and a third slanting surface on the face side of the base within the engagement socket, which third slanting surface is parallel with the protrusion-forming first slanting surface, and a female tape made of a cloth tape on which a plurality of synthetic resin female parts are molded and fastened at certain intervals, said female part comprising a base having a face side and a back side, an engagement socket in the base, an engagement protrusion having a first slanting surface and a second slanting surface and extending diagonally downwards at a slant angle in the direction of the engagement socket from the face side of the base, and a third slanting surface on the face side of the base within the engagement socket, which third slanting surface is parallel with the protrusion-forming first slanting surface, whereby, when the male and female parts are engaged, said female part forms a space for housing the male part engagement protrusion, the first slanting surface of the female part and the first slanting surface of the male part mate with each other, the second slanting surface of the female part and the third slanting surface of the male part mate with each other, and the third slanting surface of the female part and the second slanting surface of the male part mate with each other.

2. A snap fastener according to claim 1 wherein the protrusion-forming slanting surface on the engagement socket side of the male part is provided with a small protrusion, and the protrusion-forming slanting surface on the engagement socket side of the female part is provided with a step.

3. A snap fastener according to claim 2 wherein the small protrusion of the male part engages with the step of the female part when the male and female parts are completely engaged.

4. A snap fastener according to claim 1 wherein the slant angle of the protrusion forming slanting surfaces is from 30 to 60 degrees.

5. A snap fastener according to claim 1 wherein the heads of the engagement protrusions of the male and female parts are parallel with their respective cloth tapes.

6. A snap fastener according to claim 1 wherein at least one of the male and female parts is provided with a mark that indicates the directionality of the engagement.

* * * * *